US005989010A

United States Patent [19]

Martin et al.

[11] Patent Number: 5,989,010

[45] Date of Patent: Nov. 23, 1999

[54] MATRIX BED FOR GENERATING NON-PLANAR REACTION WAVE FRONTS, AND METHOD THEREOF

[75] Inventors: Richard J. Martin; John D. Stilger, both of San Jose; Mark R. Holst, Concord, all of Calif.; John D. Young, Falkirk, United Kingdom; Bradley L. Edgar, Berkeley, Calif.

[73] Assignee: Thermatrix, Inc., San Jose, Calif.

[21] Appl. No.: 08/921,815

[22] Filed: Sep. 2, 1997

[51] Int. Cl.[6] ..... F23D 3/40

[52] U.S. Cl. ..... 431/7; 431/170; 431/328

[58] Field of Search ..... 431/7, 170, 328; 122/4 D; 422/171

[56] References Cited

U.S. PATENT DOCUMENTS

| | | | |
|---|---|---|---|
| 1,812,341 | 6/1931 | Jaeger | 122/4 D |
| 2,795,054 | 6/1957 | Bowen, III | 34/35 |
| 2,976,853 | 3/1961 | Hunter et al. | 122/4 |
| 3,661,497 | 5/1972 | Castelluci et al. | 431/7 |
| 3,769,922 | 11/1973 | Furlong et al. | 110/28 J |
| 3,807,090 | 4/1974 | Moss | 48/128 |
| 3,810,732 | 5/1974 | Koch | 431/7 |
| 3,870,474 | 3/1975 | Houston | 23/277 C |
| 3,888,193 | 6/1975 | Kishigami et al. | 110/8 F |
| 3,895,918 | 7/1975 | Mueller | 23/277 C |
| 3,900,554 | 8/1975 | Lyon | 423/235 |
| 3,942,264 | 3/1976 | Zenkner | 34/35 |
| 4,047,876 | 9/1977 | Rice | 431/7 |
| 4,252,070 | 2/1981 | Benedick | 110/211 |
| 4,259,088 | 3/1981 | Moss | 48/212 |
| 4,267,152 | 5/1981 | Benedick | 422/111 |
| 4,284,401 | 8/1981 | Tatebayashi et al. | 431/7 |
| 4,285,666 | 8/1981 | Burton et al. | 431/437 |
| 4,400,356 | 8/1983 | McVay et al. | 422/171 |
| 4,475,884 | 10/1984 | Shang et al. | 431/170 |
| 4,529,374 | 7/1985 | Malik et al. | 431/7 |
| 4,627,812 | 12/1986 | Kelly ey al. | 431/7 |
| 4,643,667 | 2/1987 | Fleming | 431/7 |
| 4,646,660 | 3/1987 | Björkman et al. | 110/210 |
| 4,688,495 | 8/1987 | Galloway | 110/250 |
| 4,716,844 | 1/1988 | Koch | 110/341 |
| 4,741,690 | 5/1988 | Heed | 431/7 |
| 4,785,768 | 11/1988 | Brown et al. | 122/4 |
| 4,807,695 | 2/1989 | Ward | 165/4 |
| 4,823,711 | 4/1989 | Kroneberger et al. | 110/236 |
| 4,828,481 | 5/1989 | Weil et al. | 431/7 |
| 4,838,782 | 6/1989 | Wills | 431/166 |
| 4,870,824 | 10/1989 | Young et al. | 60/723 |
| 4,941,415 | 7/1990 | Pope et al. | 110/235 |
| 4,953,512 | 9/1990 | Italiano | 122/4 |
| 4,974,530 | 12/1990 | Lyon | 110/346 |
| 5,147,201 | 9/1992 | Xiong | 431/326 |

(List continued on next page.)

OTHER PUBLICATIONS

Burke, S.P. et al., "Diffusion Flames", *First Symposium (International) on Combustion*,1954, 2–11.

U.S. application No. 08/922,176, Martin et al., filed Sep. 2, 1997.

U.S. application No. 08/922,189, McAdams et al., filed Sep. 2, 1997.

*Primary Examiner*—Carl D. Price

*Attorney, Agent, or Firm*—Woodcock Washburn Kurtz Mackiewicz & Norris LLP

[57] ABSTRACT

A matrix bed is disclosed in which a non-planar reaction wave front is formed during operation. This is accomplished by heating the matrix bed, containing heat-resistant material, until at least a reaction portion of the matrix bed is above the temperature required for a plurality of reactant gas streams to react. Next, the reactant gas streams are directed through the matrix bed in a manner so as to form at least a Bunsen, Burke-Schumann, inverted-V, or some other type of non-planar reaction wave front at the portion of the matrix bed that is heated above the reactant gas streams reaction temperature. At the non-planar reaction wave front, the reactant gas streams react to produce a reaction product gas stream that is then exhausted from the matrix bed.

39 Claims, 12 Drawing Sheets

U.S. PATENT DOCUMENTS 5,165,884 11/1992 Martin et al. ..... 431/7
5,188,804 2/1993 Pace et al. ..... 422/111
5,320,518 6/1994 Stilger et al. ..... 422/168
5,533,890 7/1996 Holst et al. ..... 431/7
5,601,790 2/1997 Stilger et al. ..... 422/168
5,635,139 6/1997 Holst et al. ..... 422/108
5,637,283 6/1997 Stilger et al. ..... 423/245.1
5,650,128 7/1997 Holst et al. ..... 423/240 R

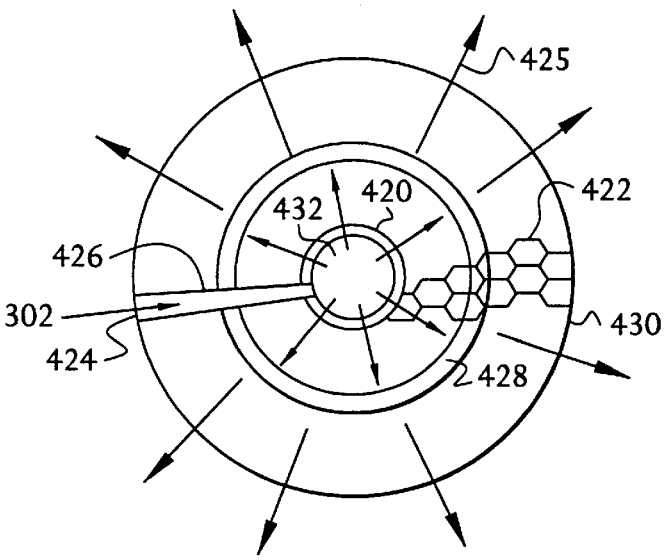
FIG. 16
FIG. 17D
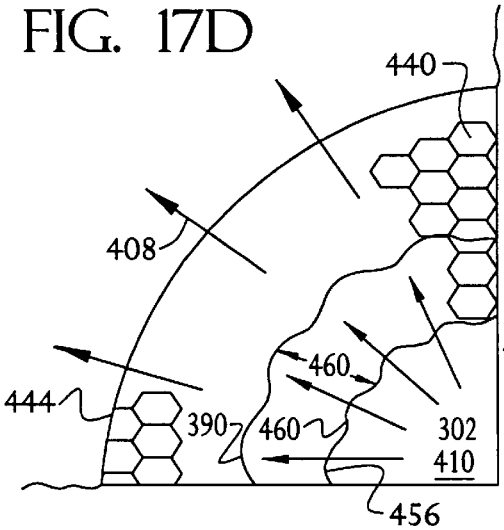
FIG. 17A
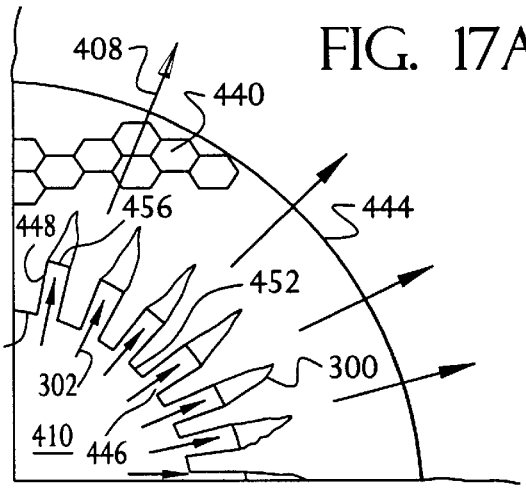
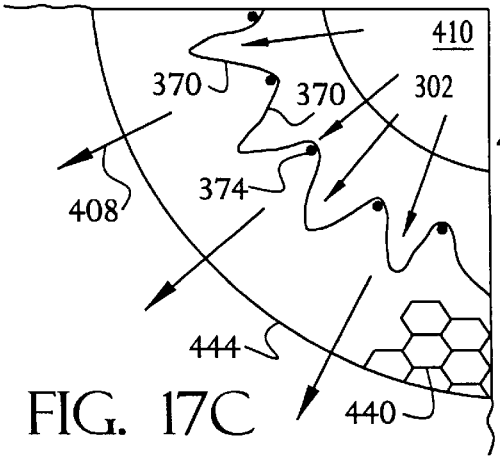
FIG. 17C
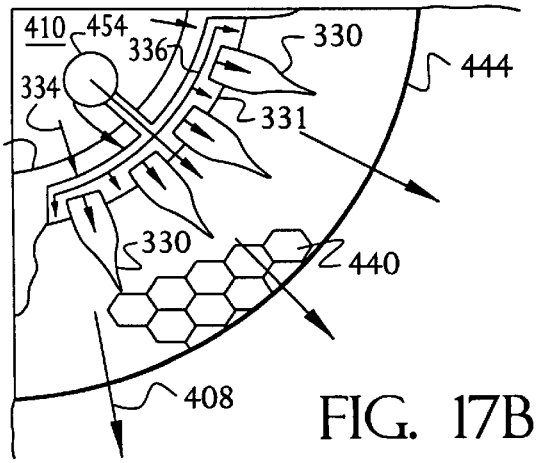
FIG. 17B

MATRIX BED FOR GENERATING NON-PLANAR REACTION WAVE FRONTS, AND METHOD THEREOF

BACKGROUND OF THE INVENTION

1. Field of the Description

This invention relates to reacting a plurality of reactant gas streams in a matrix bed of heat-resistant matter. More particularly, this invention relates to increasing the volumetric reaction rate of the matrix beds.

2. Description of the Related Art

The prior art discloses reacting a plurality of reactant gas streams in a reactor having a matrix bed of heat-resistant material such that a planar reaction wave front is formed within the matrix bed. Examples of such reactors include stabilized reaction wave flameless thermal oxidizers and recuperative heating flameless thermal oxidizers, as disclosed in U.S. Pat. No. 5,320,518 to Stilger et al. entitled "Method and Apparatus for Recuperative Heating of Reactants in an Reaction Matrix" ("Stilger"), which is incorporated herein in its entirety by reference. In general, flameless thermal oxidizers operate by flamelessly thermally oxidizing gases within a porous matrix bed of heat-resistant material. The oxidation is called "flameless" because it may occur outside the normal premixed fuel/air flammability limits. Other examples and variations of flameless thermal oxidizers are disclosed in U.S. Pat. Nos. 4,688,495; 4,823,711; 5,165,884; 5,533,890; 5,601,790; 5,635,139; 5,637,283; and the U.S. patent application Ser. No. 08/659,579 entitled "Thermal Oxidizers with Improved Preheating Means and Processes for Operating Same," filed on Jun. 6, 1996, (Attorney Docket No. THER-0248), all of which are incorporated by reference herein in their entireties.

Prior Art FIG. 1 shows an example of a stabilized wave flameless thermal oxidizer. The oxidizer comprises a processor 10 having a matrix bed 11 of heat-resistant packing material supported at the bottom by a plenum 12 for distributing a mixture of a plurality of reactant gases 18 entering the matrix 11. The packing material may be comprised of ceramic balls, saddles, or ceramic foam of varying shapes and sizes or of other suitable heat-resistant packing. A void 13 over the top of the matrix 11 precedes an exit means 25 that penetrates the end wall 14 through which exhaust gases 22 exhaust. Through the bottom of the processor 10 is an inlet means 23 through which reactant gases 18 are introduced into the processor 10. The reactant gases 18 include control air, fuel, and process gas. If necessary, the fuel, air, or process gas may be heated prior to introduction to processor 10 by applying external heat to the mixed process gas prior to entering the processor 10. The plenum and lower portion of the matrix 11 may be heated by a suitable preheater 19 that, for example, may pass forced heated air into the processor 10, or heat the bed by electrical means. At various points in the matrix 11 are located temperature sensing devices such as thermocouples 20 from which the output is fed into a microprocessor or programmable logic controller 21 that, in turn, controls the proportions, volumetric flowrate, and temperature of the input gases entering the processor 10. The term "volumetric flowrate" shall be understood to refer to volumetric flowrate and/or mass flowrate.

Referring now to Prior Art FIG. 2, there is shown a schematic of the internal temperature zones and reaction wave front 22 of the stabilized reaction wave flameless thermal oxidizer. Typically, during operation, there will be a cool zone 27 below the uniform oxidation or combustion temperature that is being maintained within the reaction wave front. A planar reaction wave front 22 occurs in the matrix and has a stable shape with a radial, substantially uniform temperature distribution. Above the planar reaction wave front 22 will be a hot region 26. By using temperature sensors 20, the planar reaction wave front 22 may be relocated within the matrix by controlling the volumetric flows and conditions at the input end of the processor 10.

Referring now to Prior Art FIG. 3, a processor 80 of a recuperative heating flameless thermal oxidizer has an inlet port 88, an exhaust port 90, a heating port 92, a barrier 100, and a matrix bed 104. The inlet port 88 leads to an inlet plenum 94 at the bottom of the processor 80. A number of feed tubes 96 extend through an impermeable, rigid tubesheet 98 preferably made of steel or metal alloy, and a heat-resistant ceramic insulating barrier 100 at the roof of the plenum 94. The tubesheet 98 provides mechanical support for the tubes 96. The lower ends of the feed tubes 96 are provided with caps 102 to retain the matrix bed 104 inside the tubes 96. The caps 102 are provided with orifices 106 to permit the flow of gases from the inlet plenum 94 to the tubes 96. The matrix bed 104 is made up of heat-resistant packing material, as with the stabilized wave flameless thermal oxidizer, that is supported by the barrier 100. The packing material fills the region between the barrier 100 and the void 108 at the top of the processor 80 including the interior of the feed tubes 96. The matrix bed 104 may be heated by forcing heated gases, such as air, in through the heating port 92, and extracting the heated gases through the exhaust port 90. Alternatively, the bed may be heated by electric heaters or other means. During preheating, a low volumetric flow of ambient air may be bled through the inlet port 88 and up through the heat exchanger/feeding tubes 96 to ensure the tube material is not overheated, and to help establish the desired system temperature profile. Once the matrix bed 104 of the recuperative heating flameless thermal oxidizer has been preheated, the gases are introduced to the processor 80 through the inlet port 88. An adjusting means (not shown), that is analogous to the microprocessor or programmable logic controller 21 shown in Prior Art FIG. 1, also controls the volumetric flowrate and composition of the process gases to maintain a stable, planar reaction wave front that is similar to the planar reaction wave front 22 shown in Prior Art FIG. 2. Exhaust gases are extracted from the processor 80 through the exhaust port 90.

Now referring to Prior Art FIG. 4, a regenerative bed destruction system 210, an example of which is disclosed in U.S. Pat. No. 5,188,804 to Pace et al., entitled "Regenerative Bed Incinerator and Method of Operating Same" ("Pace"), and which is incorporated herein in its entirety by reference, may also be used to treat plurality of reactant gas streams 203. The destruction system 210 comprises a housing 212 enclosing a matrix bed 214, a lower gas plenum 216 disposed subadjacent the matrix bed 214, and an upper gas plenum 218 disposed superadjacent the matrix bed 214. Both the lower gas plenum 216 and the upper gas plenum 218 are provided with gas flow aperture openings 220 and 220', respectively. These openings 220 and 220' alternately serve as gas flow inlets or outlets depending upon the general direction of the flow of the reactant gas streams mixture through the matrix bed, which is periodically reversed as discussed hereinafter. A heating means 222, such as an electric resistance heating coil, is embedded within the central portion of the matrix bed 214. The heating means 222 is selectively energized to preheat the material in the central portion of the matrix bed 214 to a temperature sufficient to initiate and sustain a planar reaction wave front similar to the planar reaction wave front 22 shown in Prior Art FIG. 2.

During operation of the regenerative bed destruction system 210, the gas stream 203 flows into the bed 214 through either the lower gas plenum 216 or the upper gas plenum 216. The gas stream 203 flows through a supply duct 240 to a valve means 230. The valve means 230 receives the stream 203 through a first port 332 and selectively directs the received streams 203 through either the second port 234 or the third port 236. When the gas stream 203 is directed through the second port 234, the gas stream flows through duct 260 and opening 220 and into the lower plenum 216. When the gas stream 203 is directed through the third port 236, the gas stream flows through the duct 260' and opening 220' and into the upper plenum 218. The fourth port 238 of the valve means 230 is connected to the exhaust duct 270 through which the reactant product gas stream 205 is vented to the atmosphere. At spaced time intervals, the valve means 230 is actuated by controller 280 to reverse the flow of gases through the matrix bed 214. Every time that the flow is reversed, the role of the lower and upper gas plenums 216 and 218 is reversed with one going from serving as an inlet plenum to serving as an outlet plenum for the destruction system 210, while the other goes from serving as an outlet plenum to serving as an inlet plenum for the destruction system 210. In this manner, the upper and lower portions of the matrix bed alternately absorb heat from the reactant product gas stream leaving the central portion of the matrix bed from the shifting planar reaction wave front (not shown).

As previously noted, it is necessary to redirect the flow of gas stream 203 through the regenerative bed destruction system 210 to maintain a proper, planar, temperature profile within the matrix bed 214. Optimally, the planar temperature profile is hottest in the bed's center and cooler at its upstream and downstream edges. During proper operation, the reaction wave front migrates back and forth in the central portion of the matrix bed 214 in a direction parallel to the gas flow. If the gas flow direction is not properly switched, the reaction wave front will move out of the central portion of the matrix bed 214 and destroy the optimum temperature profile. To switch the gas flow direction, a controller means 280 activates the gas switching means 230 at timed intervals to reverse the direction of flow of the process exhaust gases. The controller means 280 also selectively activates the gas switching valve means 230 in response to the temperature of the reactant product gas stream 205. To this end, a temperature sensing means 290, such as a thermocouple, is disposed in the exhaust gas duct 270 at a location downstream of the gas switching valve means 230 for measuring the temperature of the reactant product gas stream 205. The temperature sensing means 290 generates a temperature signal 295 that is indicative of the temperature of the stream 205 leaving the downstream portion of the matrix bed 214, and transmits the temperature signal 295 to the controller means 280.

Other regenerative bed destruction systems may have multiple matrix beds, as is disclosed in U.S. Pat. Nos. 4,267,152 to Benedick entitled "Anti-Pollution Thermal Regeneration Apparatus" ("Benedick"); 3,895,918 to Mueller entitled "High Rate Thermal Regeneration Anti-Pollution System" ("Mueller"); 3,870,474 to Houston entitled "Regenerative Incinerator Systems for Waste Gases" ("Houston"); and 4,741,690 to Heed entitled "Process for Combustion or Decomposition of Pollutants and Equipment Therefor" ("Heed"), all of which are incorporated herein in their entireties by reference. In these systems (not shown), the plurality of reactant gas streams react in a first matrix bed, pass through an incinerator, and pass through a second matrix bed. The flow of the plurality of reactant gas streams is later reversed such that streams react in the second matrix bed, pass through the incinerator, and through the first matrix bed. As the gases react in the initial matrix bed through which they flow, they may or may not form a reaction wave.

These and other matrix bed reactor systems that form a reaction wave have an overall volumetric reaction rate limited by the area of the wave front. The overall volumetric reaction rate is the reactions occurring per matrix bed volume per time. The volumetric flowrates of the reactant gas streams are adjusted to establish and maintain the planar reaction wave front within the matrix bed. The overall volumetric reaction rate of the reactant gas streams cannot be raised by merely increasing the gas stream volumetric flowrates as this would push the planar reaction wave front out of the matrix bed, regardless of matrix bed length. To accommodate increased volumetric flowrates, the cross-sectional area of the matrix bed needs to be increased, thereby increasing the area of the planar reaction wave front.

However, simply increasing the area of the existing planar reaction wave front to accommodate increased reactant gas streams increases the size, and cost, of the matrix bed. Matrix bed reactor systems that generate planar reaction wave fronts have limits on their overall volumetric reaction rates based on their cross sectional areas. As a result, the volume of the matrix bed is dictated by the amount of reactions that will occur in the planar reaction wave front, preventing the design of a reduced-size matrix bed for applications with limited available space.

Thus, a need exists to provide a matrix bed with an increased overall volumetric reaction rate for reacting a plurality of reactant gas streams in a reaction wave front with the matrix bed having reduced fabricating costs and/or reduced space requirements.

SUMMARY OF THE INVENTION

The present invention is directed toward matrix beds providing optimized overall volumetric reaction rates that are configured so as to react a plurality of reactant gas streams in at least a non-planar wave front.

Accordingly, it is an alternative object of the invention to provide a method for increasing the overall volumetric reaction rate of one or more reactant gas streams reacting to form one or more non-planar reaction wave fronts in a matrix bed comprising heat-resistant matter. The non-planar reaction wave front may take the form of a Bunsen reaction wave front, a Burke-Schumann reaction wave front, an inverted-V reaction wave front, a non-planar reaction wave front that corresponds to a non-planar surface of the matrix bed, a non-planar reaction wave front that is the result of using a matrix bed having a plurality of flow control portions, or a combination thereof. All of the methods for producing these types of reaction wave fronts have a number of similar steps comprising heating the matrix bed until at least a reaction portion of the matrix bed is above the temperature required for the reactant gas streams to react; introducing the reactant gas streams into the matrix bed in a manner to form a reaction wave front in the reaction portion of the matrix bed; and the reaction creating a reaction product gas stream that is then exhausted from the matrix bed.

In the alternative objective of the invention that produces a Bunsen reaction wave front, the reactant gas streams are mixed and divided to form one or more individual gas streams. The individual gas streams are introduced into the bed at one or more introduction locations, resulting in the Bunsen reaction wave fronts forming in the reaction portion of the matrix bed.

In the alternative objective of the invention that produces Burke-Schumann reaction wave fronts, first and second portions of the reactant gas streams are mixed to form first and second mixed gas streams. The first and second mixed gas streams may be fuel and oxidizer, respectively. The first mixed gas stream is divided to form one or more individual gas streams. The individual gas streams are introduced into the matrix bed at one or more introduction locations disposed downstream of a gas permeable surface of the matrix bed. The second mixed gas stream is then directed through the gas permeable matrix bed surface. The individual gas streams react with the second mixed gas stream and form the Burke-Schumann reaction wave fronts in the reaction portion of the matrix bed.

In the alternative objective of the invention that produces one or more inverted-V reaction wave fronts in a matrix bed, wave holders anchor portions of the front to form the inverted-V reaction wave front.

In the alternative objective of the invention that produces one or more non-planar reaction wave fronts in a matrix bed that correspond to a non-planar surface of the matrix bed, the reactant gas streams are directed through the non-planar surface of the matrix bed in a plurality of directions in a manner so as to form at least a non-planar reaction wave front in the matrix bed.

In the alternative objection of the invention that produces one or more non-planar reaction wave fronts as a result of using a matrix bed having a plurality of flow control portions, the flow control portions are defined by their linear gas velocity characteristics. The flow control portions are arranged to enable the formation of the non-planar reaction wave fronts.

Other and further objects and advantages will appear hereinafter.

BRIEF DESCRIPTIONS OF THE DRAWINGS

Prior Art FIG. 1 is a schematic view of a stabilized reaction wave flameless thermal oxidizer.

Prior Art FIG. 2 is a schematic view of the stabilized reaction wave flameless thermal oxidizer of Prior Art FIG. 1 showing the planar reaction wave front in the matrix bed.

Prior Art FIG. 3 is a schematic view of a recuperative heating flameless thermal oxidizer.

Prior Art FIG. 4 is a schematic view of a regenerative bed incinerator system.

FIG. 16 is a cross-sectional view of an embodiment of the present invention having a spherically-shaped matrix bed.

FIGS. 17A–D are detailed views of a lateral cross-section of an embodiment of the present invention having a cylindrically-shaped matrix bed with Bunsen conical, Burke-Schumann, inverted-V, and non-planar wave fronts.

Figure 18:
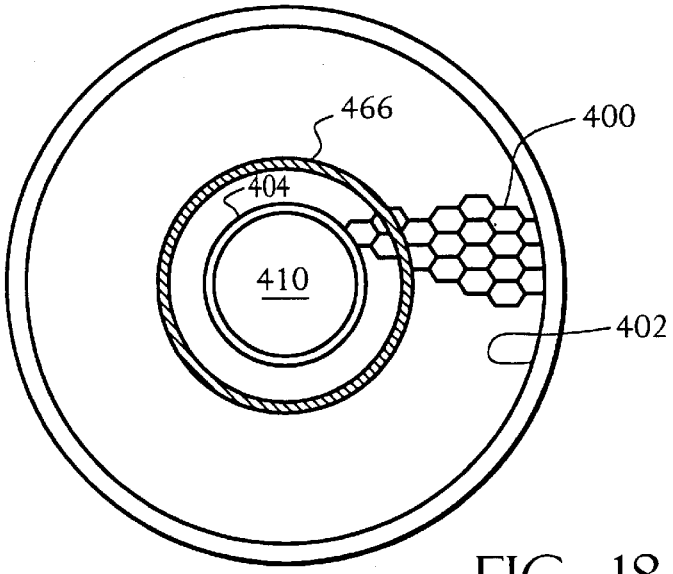

FIG. 18 is a lateral cross-sectional view of an embodiment of the present invention having a cylindrically-shaped matrix bed with circular rods disposed therein.

Figure 19:
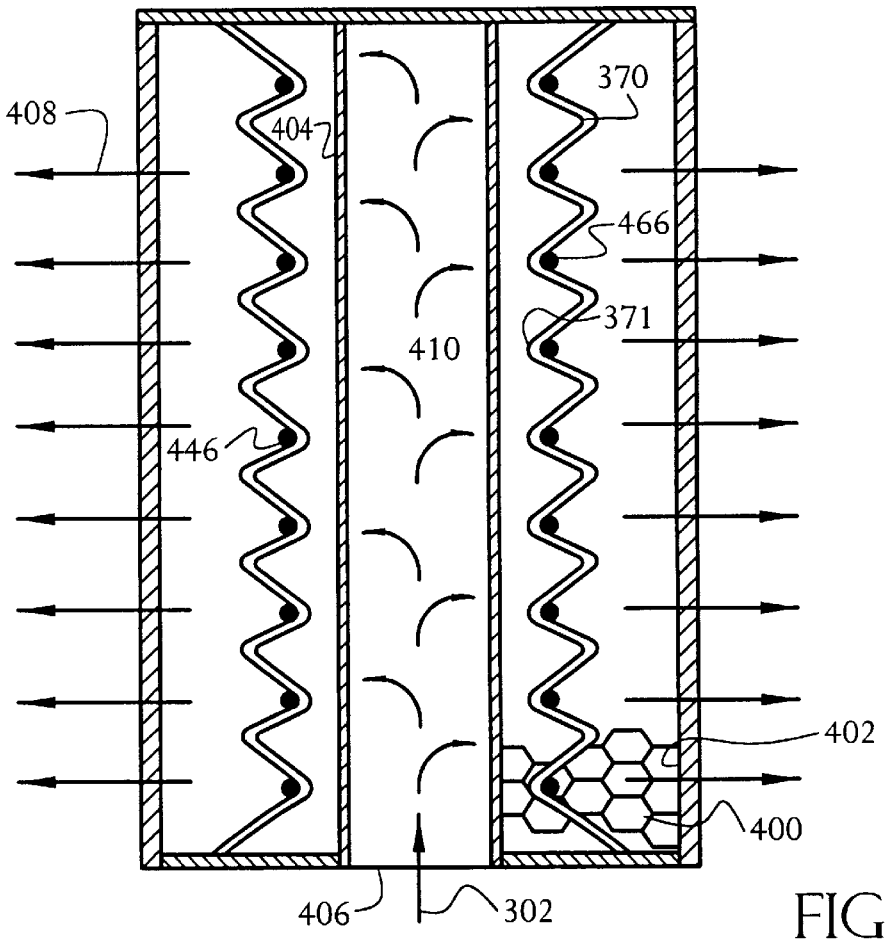

FIG. 19 is an axial cross-sectional view of an embodiment of the present invention having a cylindrically-shaped matrix bed with circular rods disposed therein and an inverted-V reaction wave front extending therefrom.

DETAILED DESCRIPTION OF THE PREFERRED EMBODIMENTS

Figure 5:
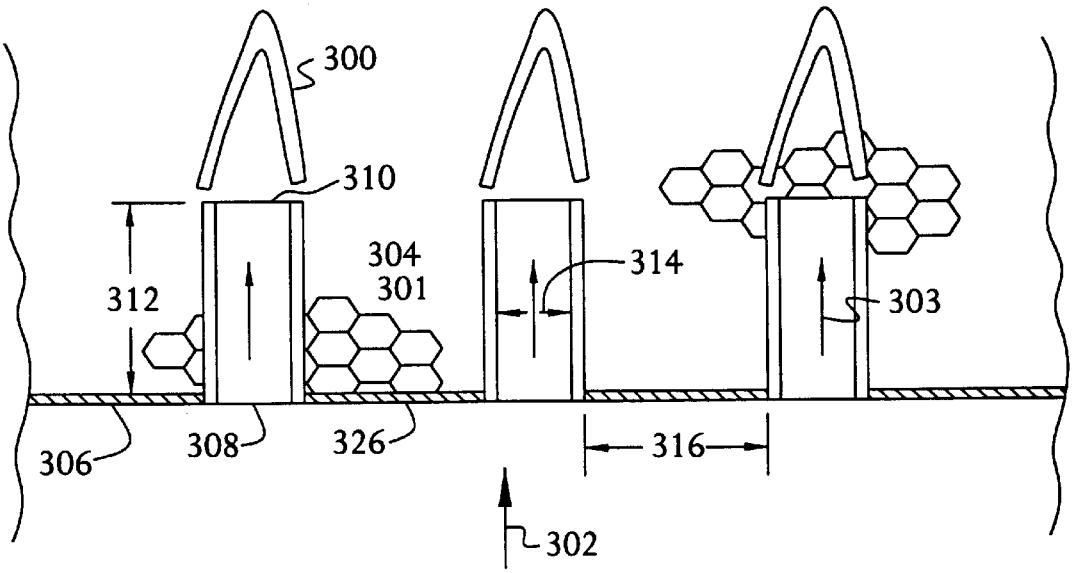
FIGS. 5 and 6 are detailed views of embodiments of the present invention having non-planar, Bunsen reaction wave fronts in a matrix bed.

Referring now to the figures, wherein like reference numerals refer to like elements, and in particular to the inventive embodiment of FIG. 5, a plurality of non-planar, Bunsen reaction wave fronts 300 are formed by the reaction of a mixed gas stream 302 of a plurality of reactant gas streams flowing through tubes 304 extending through a planar surface 326 and into the matrix bed 301. The term "non-planar" shall be understood to mean that all of the elements of a feature do not define a single plane, even through individual elements of the feature may define one or more planes. The terms "Bunsen" and "Bunsen cone" shall be understood to mean a combustion reaction wherein an oxidizable gas and oxygen are premixed prior to combustion and forms a conical reaction wave front. The plurality of gas streams comprises gases that react rapidly with each other and form a reaction wave front when intermixed in the proper ratios and elevated to a reaction temperature, i.e., oxidizable gases mixed with air and/or oxygen in a proper ratio combust rapidly in a reaction wave front when elevated to above the oxidizable gases auto-ignition temperature.

The surface 326 of the matrix bed 301 is adjacent to, and supported by, a bed support 306, although other embodiments of the invention may have matrix beds that do not require bed supports. As with the reactors previously described, at least a reaction portion of the matrix bed 301 is preheated to a temperature that will sustain the fronts 300, prior to the stream 302 entering it. The bed support 306 is a gas flow prevention surface, thereby directing all the gases to flow through the tubes 304 extending therethrough. Other embodiments of the invention may have a bed support that gases do flow through for preheating the matrix bed 301 or other purposes.

The tubes 304 extend through the bed support 306 and the surface 326 and divide the mixed gas stream 302 into a plurality of individual gas streams 303. In the embodiment shown, the streams 303 flow into a first open end 308 of each tube that is located at the bed support 306, but other embodiments of the invention may have the first open end located at some other position at, or upstream of, the surface 326 or connected directly with the source of stream 302. The gases flow out of each tube 304 through a second open end 310 and into the matrix bed 301. The second open end 310 is located downstream of the surface 326 at an introduction location. The second open end 310 is circular in shape, but other embodiments of the invention may have openings of other shapes. The height 312 and the diameter 314 of the tubes 304 varies depending upon application. Further, the distances 316 between the tubes 304 and the arrangement of the tubes (not shown) may vary between embodiment. Alternatively, tubes 304 may be omitted such that reaction wave 300 may form adjacent to the holes 308 in bed support 306.

Figure 6:
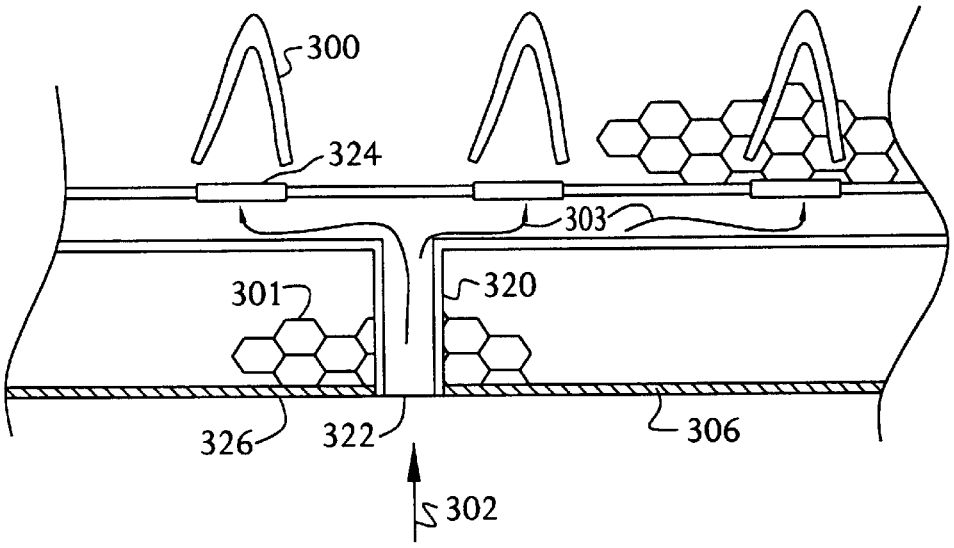

Besides the tubes 304, other arrangements may be used to establish and maintain the non-planar, Bunsen reaction wave fronts 300. Referring to FIG. 6, a manifold 320 has an inlet 322 into which the mixed gas stream 302 flows. The inlet 322 is located at the surface 326. The manifold 320 divides the gas stream 302 into the individual gas streams 303 that flow out of the manifold 320 through outlets 324 located in the matrix 301 at introduction locations that are downstream of the surface 326. Other embodiments of the invention may have the inlet located upstream of the surface 326, extending through a side wall of the reactor, or some other suitable configuration.

Figure 1:
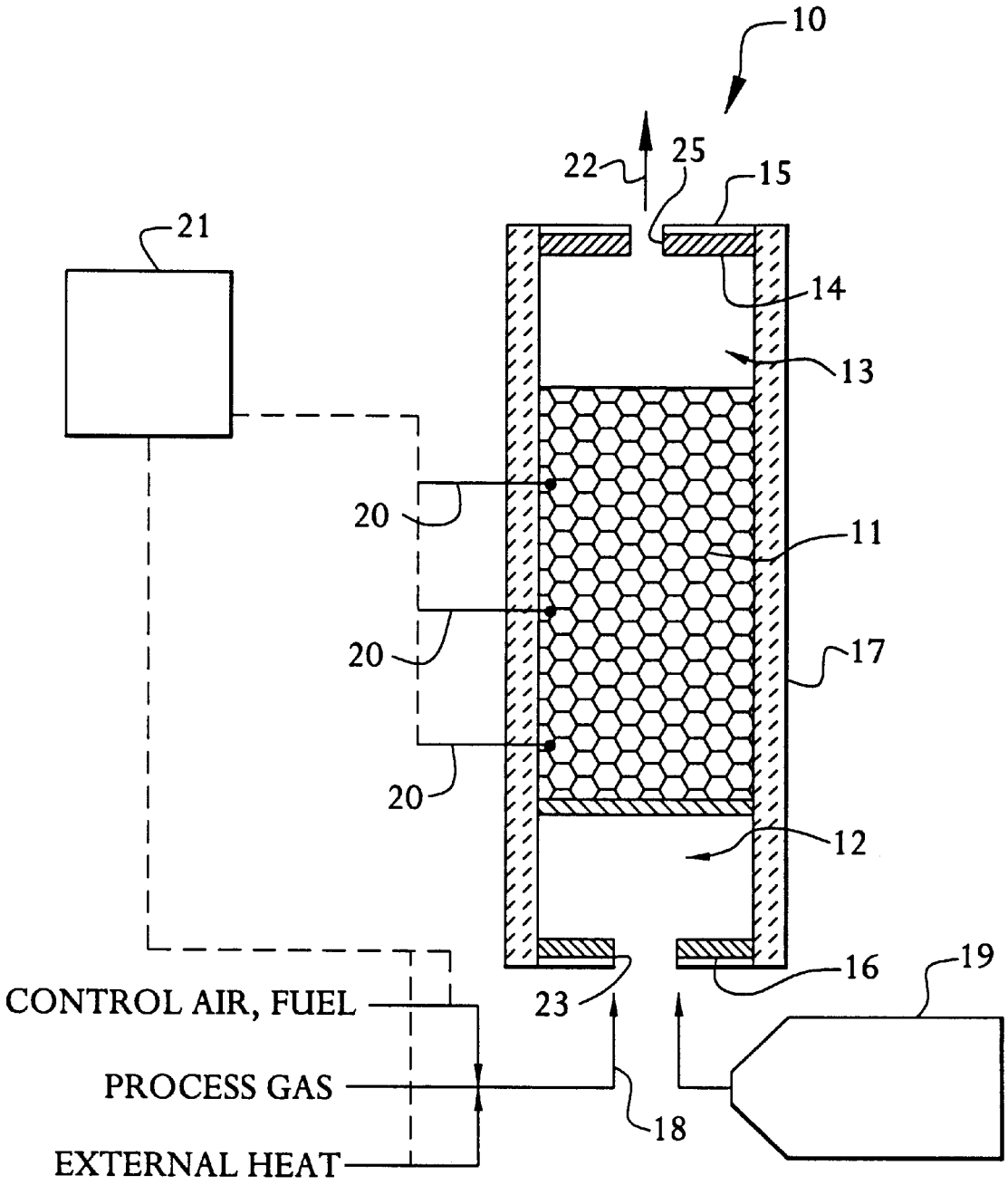
FIG. 1 (PRIOR ART)
Figure 2:
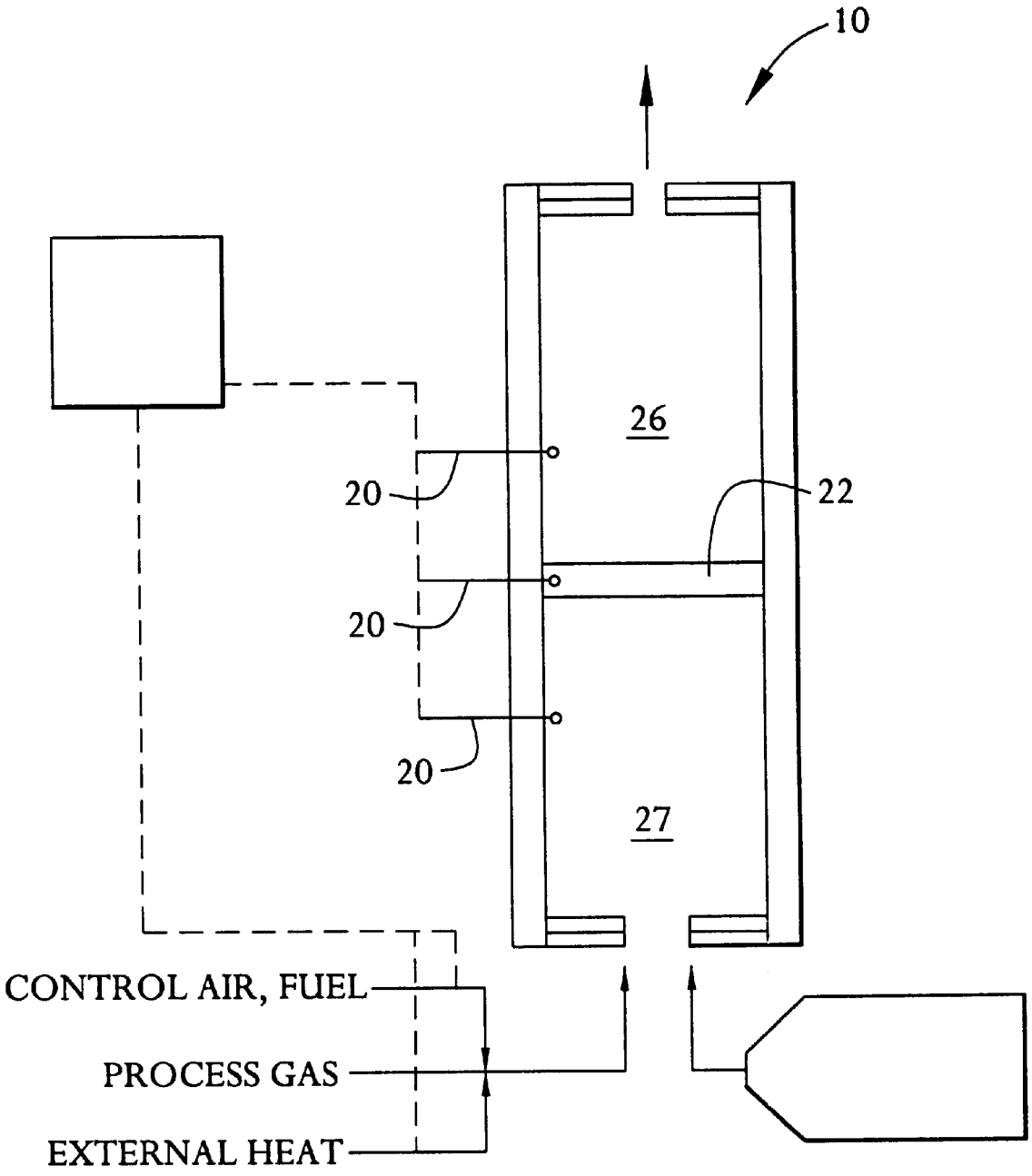
FIG. 2 (PRIOR ART)
Figure 3:
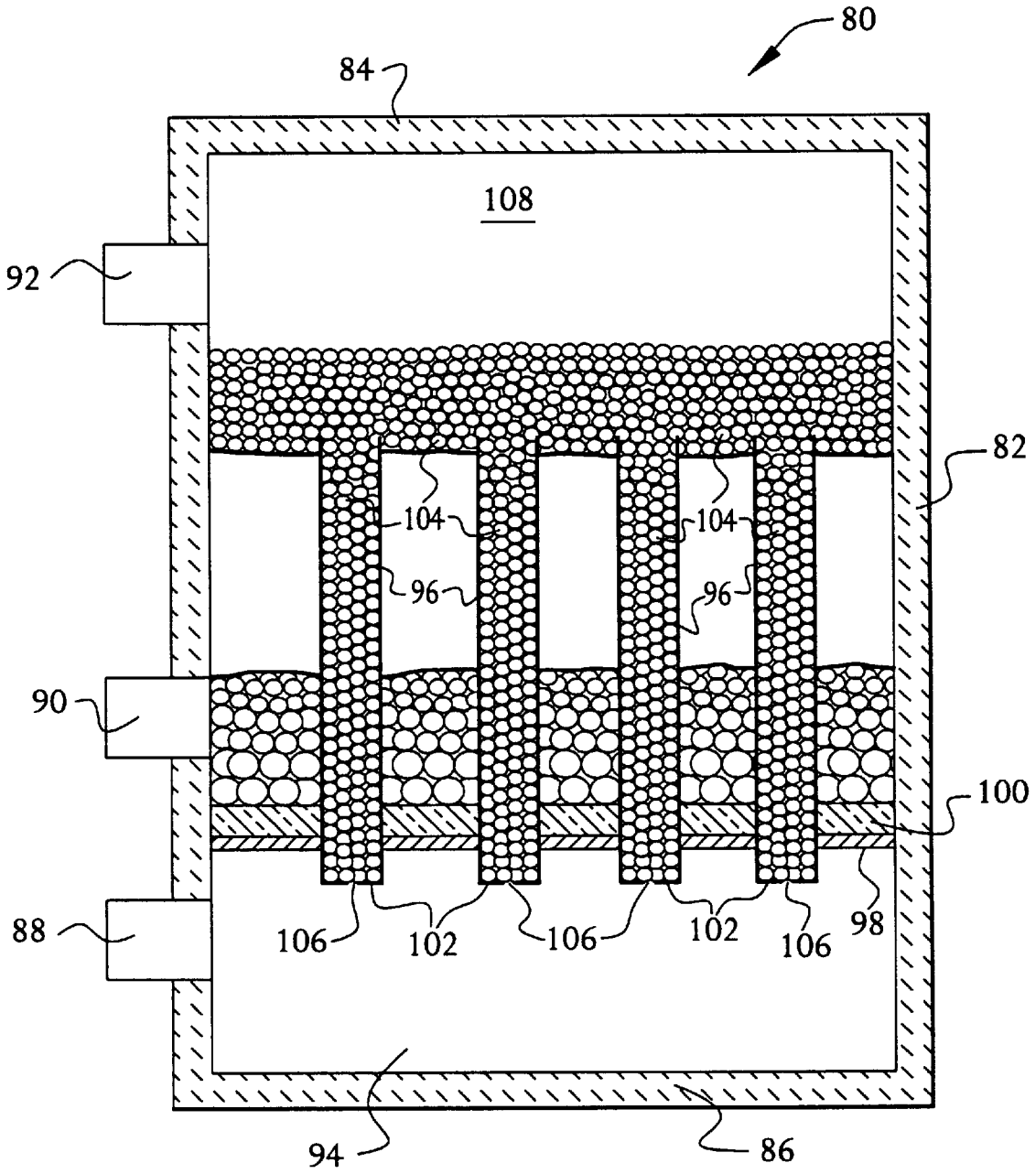
FIG. 3 (PRIOR ART)
Figure 4:
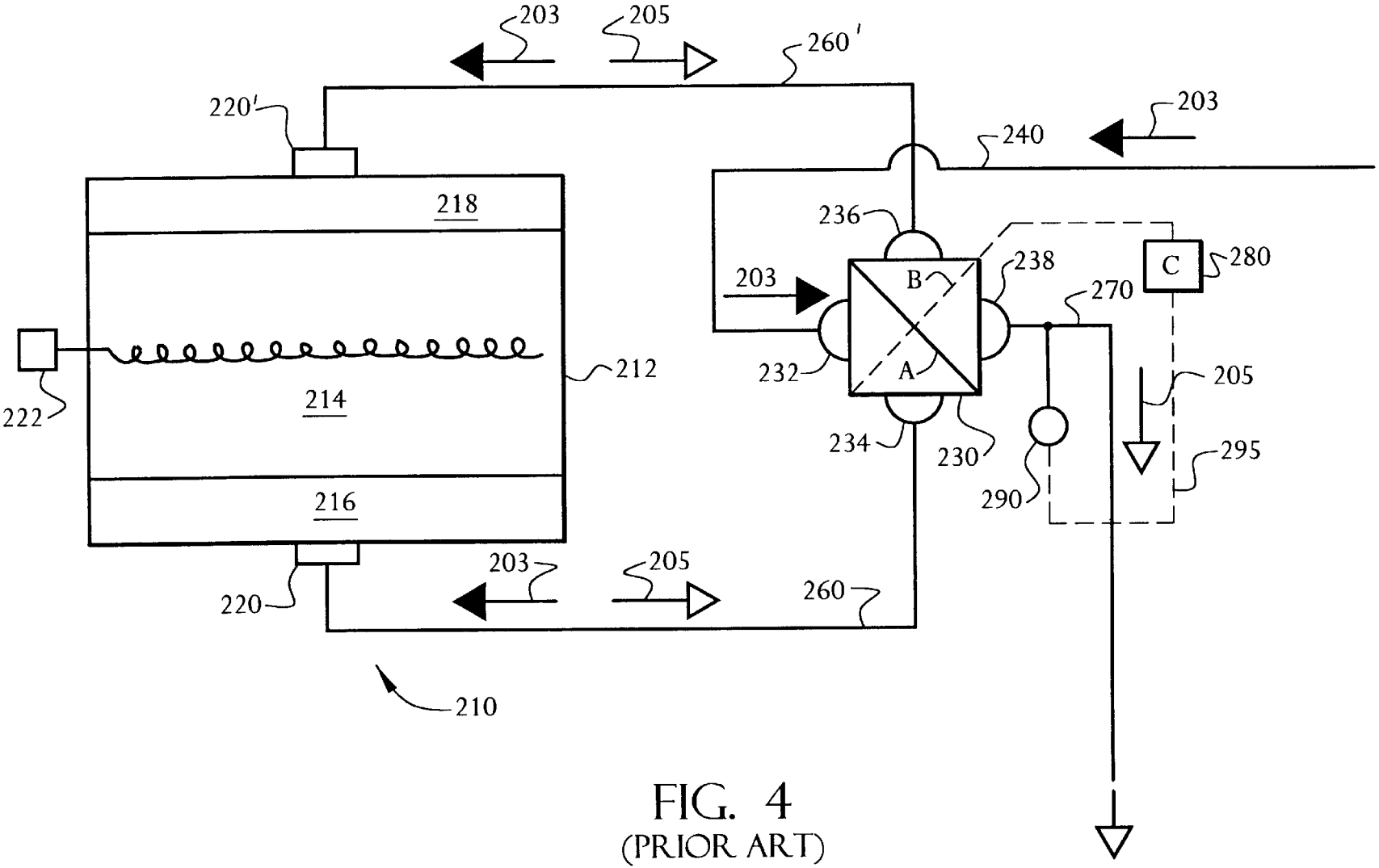
FIG. 4 (PRIOR ART)

An embodiment of the invention may have the matrix bed 301 in a stabilized reaction wave flameless thermal oxidizer. An additional alternative embodiment of the invention may have the manifold inlet extending through the matrix bed 301 like the feed tubes 96 of the recuperative heating flameless thermal oxidizer in Prior Art FIG. 3 such that the mixed gas stream 302 recoups thermal energy from the matrix bed. A further embodiment of the invention may have multiple manifolds with outlets 324 at different depths in the matrix bed 301 such that the position of the wave 300 may change as is necessary in a regenerative bed incinerator system such as shown in Prior Art FIG. 4 and the like.

As the Bunsen reaction wave fronts 300 are non-planar, they have an increased area of the reaction wave front per cross-sectional area (or plan area) of the matrix bed 301 compared to a planar reaction wave front. This increased area of the reaction wave front results in increased reactions per volume of the matrix bed, thus increasing the matrix bed's overall volumetric reaction rate. As a result, a less expensive and smaller matrix bed with a Bunsen reaction wave front will react the same volume flow of reactant gases as a more expensive and larger matrix bed with a planar reaction wave front.

Figure 7:
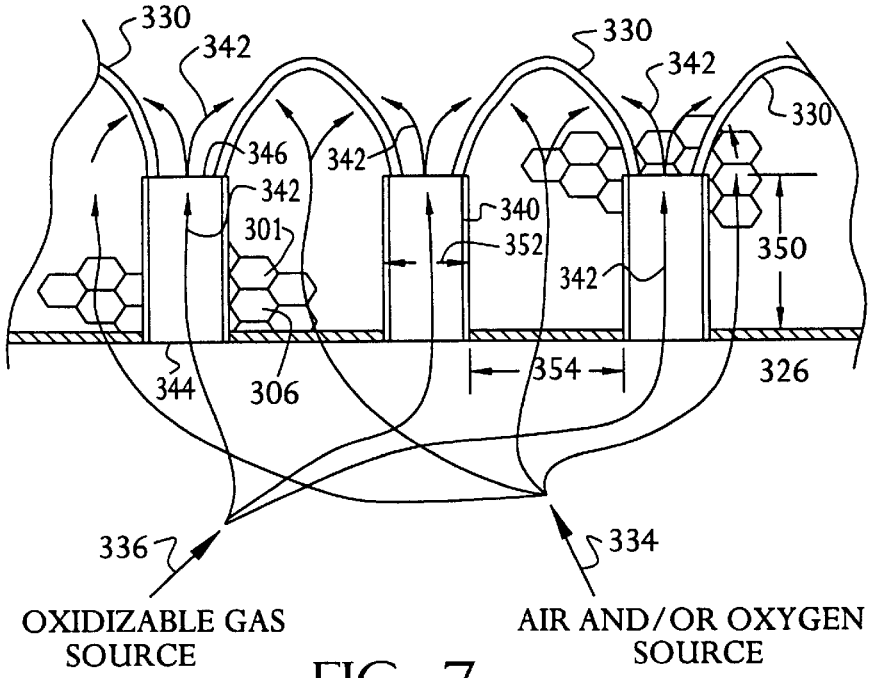
FIGS. 7 and 8 are detailed views of embodiments of the present invention having non-planar, Burke-Schumann reaction wave fronts in a matrix bed.

Now referring to FIG. 7, which illustrates an alternative embodiment of the present invention, a plurality of non-planar, Burke-Schumann reaction wave fronts 330 are formed by the reaction of portions 334 and 336 of the plurality of reactant gas streams in the matrix bed 301. The term "Burke-Schumann" shall be understood to describe a combustion reaction where an oxidizable gas and the oxygen are diffused together under conditions such that combustion occurs. This type of combustion reaction is also know as a "diffusion flame" and is described in Burke, S. P. and Schumann, T. E. W., *Diffusion Flames,* First Symposium (International) on Combustion, p. 2, (1954), which is incorporated in its entirety by reference herein. In this preferred embodiment of the invention, the portion 334 is a mixture of the reactant gas streams that comprise air and/or oxygen and the portion 336 is a mixture of the reactant gas streams that comprise oxidizable gases. As with the reactors previously described, the matrix bed 301 is preheated to a temperature that will initiate the self-sustained reaction fronts 330.

In the embodiment of the invention shown in FIG. 7, tubes 340 extend through the bed support 306 and the surface 326 and divide the portion 336 of the reactant gas streams into a plurality of individual gas streams 342. The streams 342 flow into a first open end 344 of each tube 340. The first open ends 344 are operatively connected to an oxidizable gas source through a manifold means (not shown). The gases flow out of each tube 340 through a second open end 346 and into the matrix bed 301. The second open end 346 is located downstream of the surface 326. In the preferred embodiment, the second open end 310 is circular in shape, but other embodiments of the invention may have openings of different shapes. The height 350 and the diameter 352 of the tubes 340 varies depending upon application and may also vary between individual tubes 340 in the same matrix bed. Further, the distances 354 between the tubes 340 and the arrangement of the tubes (not shown) may vary as well.

The air and/or oxygen gas stream portion 334 of the plurality of gas stream flows through the surface 326 and into the matrix bed 301. The portion 334 diffuses into the individual gas streams 342 after they have passed through the second open ends 346. Additionally, the temperature of the matrix bed 301 in the region of the second open ends 346 is above the temperature required for the portion 334 and streams 342 to react. When the portions 334 and individual gas streams 342 interdiffuse, they react and form the Burke-Schumann reaction wave fronts 330. An embodiment of the invention may flow the oxidizable gases through the surface 326 and the air and/or oxygen gas stream through the tubes 340. Another embodiment of the invention may preheat either one of the streams.

Figure 8:
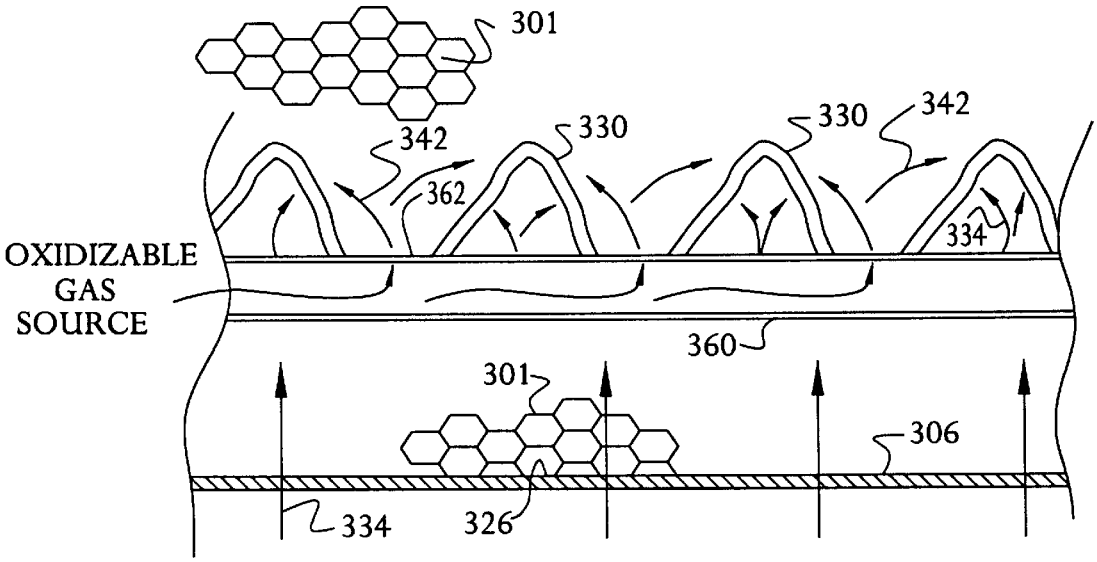

Besides the tubes 340, other arrangements may be used to establish and maintain the non-planar, Burke-Schumann reaction wave fronts 330. Referring to FIG. 8, a manifold 360 receives the portion 336 of the reactant gas streams and divides the gas stream into the plurality of individual gas streams 342 that flow out of the manifold 360 through outlets 362 located in the matrix 301 and downstream of the bed support 332 at introduction locations. The outlets 362 are circular in shape, but other embodiments of the invention may have outlets of other shapes. In an embodiment of the invention, the inlet (not shown) of the manifold 360 may extend through the bed support 306, as did the manifold inlet 332 of the embodiment of the invention shown in FIG. 6. In another embodiment of the invention, the manifold 360 inlet may extend through a side wall of the reactor. In a further embodiment of the invention, the manifold 360 inlet may extend through the matrix bed 301 similarly to the feed tubes 96 of the recuperative heating flameless thermal oxidizer in Prior Art FIG. 3 such that the oxidizable gas portion 336 recoups thermal energy from the matrix bed. In an additional embodiment of the invention, the matrix bed may be in a regenerative bed incinerator system of Prior Art FIG. 4 and the like, the matrix bed having multiple manifolds at different depths in the matrix bed 301 such that the position of the wave 330 may change as necessary.

As described previously in connection with the Bunsen reaction wave fronts 300, the Burke-Schumann reaction wave fronts 330 are non-planar with an increased area of the reaction wave front per cross-sectional area of the matrix bed 301 compared to a planar reaction wave front. This increased area enables an increased amount of reactions per volume of the matrix bed, thus increasing the matrix bed's overall volumetric reaction rate. As a result, a less expensive and smaller matrix bed with a Burke-Schumann reaction wave front will react the same volume flow of reactant gases as a more expensive and larger matrix bed with a planar reaction wave front.

Figure 9:
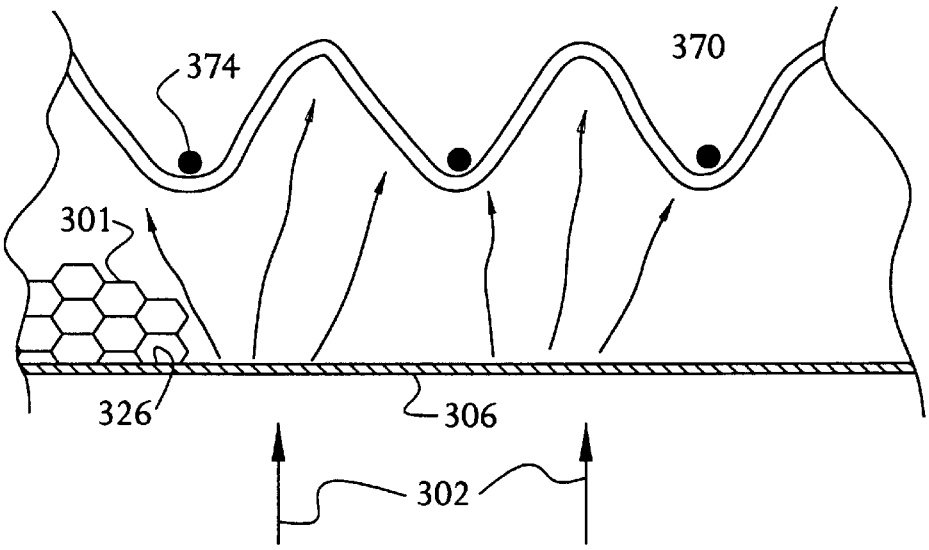
FIGS. 9 and 10 are detailed views of embodiments of the present invention having non-planar, inverted-V reaction wave fronts in a matrix bed.

Now referring to FIG. 9, another embodiment of the present invention uses wave holder means 374 to anchor the reaction of the mixed gas stream 302. The mixed gas stream 302 flows through the bed support 306, through the surface 326, and into the matrix bed 301. A non-planar, inverted-V reaction wave front 370 forms when the matrix bed 301 immediately downstream of the wave holder means 374 is at the reaction temperature required for the mixed gas stream 302 to react in a front and the linear gas velocity of the stream is greater than the reaction velocity. The linear gas velocity is the average rate of motion of the gas stream, expressed in units of length/time, as contrasted with the volumetric flow rate having units of volume of gas/time or mass/time. The reaction velocity is the rate at which a reaction wave front progresses upstream. Without the wave holder means 374, the reaction wave front will "blow out of," or cease to exist in, the matrix bed 301 when the linear gas velocity of the stream is greater than the reaction velocity. By using the wave holder means 374, the matrix bed 301 can process a higher volumetric flow rate of mixed gases and, therefore, have a higher overall volumetric reaction rate.

In the embodiment of the invention as shown in FIG. 9, the wave holder means 374 are rods extending through the matrix bed 301 and across the direction of the gas flow. The rods are bluff bodies that hold the reaction wave front through recirculation flow patterns in the vicinity of the rods. Other embodiments of the invention may use other bluff bodies to hold the reaction wave. Additional embodiments of the invention may heat the bluff bodies and other wave holder means 374 with a heating means (not shown) by electrical resistance, corona discharge, U.V. photolysis or some other means. Still further embodiments of the invention may use wave holder means 374 in the recuperative heating flameless thermal oxidizer as shown in Prior Art FIG. 3 and the like. Still further embodiments of the invention may use multiple levels of wave holder means 374 at a variety of depths in the matrix bed 301 such that the position of the wave front 370 may change as necessary in the regenerative bed incinerator system as shown in Prior Art FIG. 4 and the like.

Figure 10:
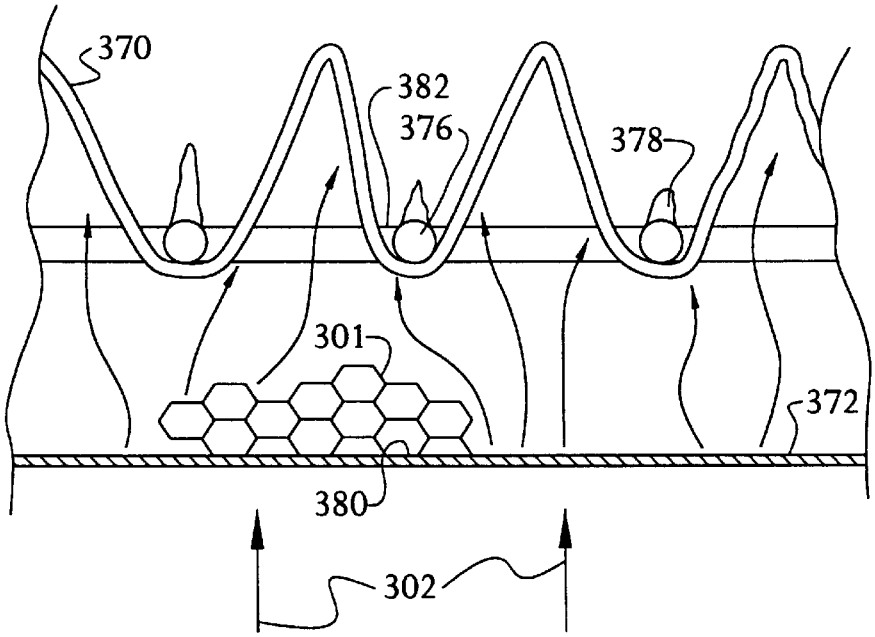

Now referring to FIG. 10, another embodiment of the invention uses pilot as 378 (or ignitors) from pilot holes 376 to anchor and form the non-planar, inverted-V reaction wave front 370. A manifold 382 preferably delivers a combustible gas to the pilot holes 376 to form raw fuel jets. Alternatively, manifold 382 may deliver a raw liquid fuel, or any combination of gaseous fuel, liquid fuel, air, and oxygen. The term "raw" as used herein and in the appended claims refers to a fuel stream or a fuel-rich stream. The present invention encompasses employing any such combination to form pilot 378. The pilots 378 operate in the same manner as previously described for rods 374 and other structures as a wave holder means to form a front and may be used in a stabilized reaction wave flameless thermal oxidizer, a recuperative heating flameless thermal oxidizer, or a regenerative bed incinerator system. To accomplish suitable wave holding, the pilots 378 preferably are 100 degrees F. to 1500 degrees F. hotter than the adiabatic reaction temperature of the product stream of the bulk gases. Even more preferably, the pilots 378 are approximately 400 degrees F. hotter than the adiabatic temperature of the product stream. An equivalent to using pilots 378 is to locally ionize the gases to initiate and anchor the wave front.

Figure 11:
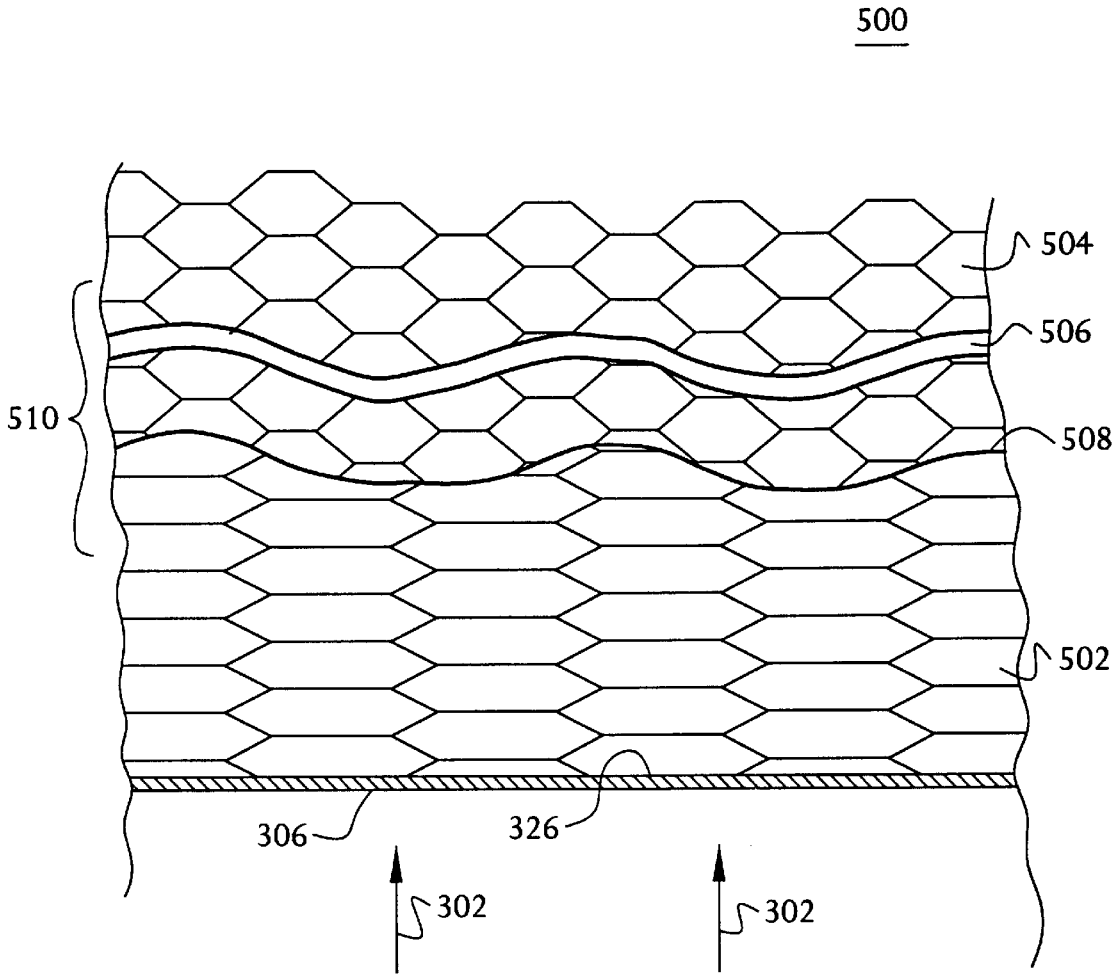
FIG. 11 is a detailed view of an embodiment of the present invention having a plurality of flow control portions that enable the formation of non-planar reaction wave fronts.

Now referring to FIG. 11, another embodiment of the invention uses an engineered matrix bed 500 with a first flow control portion 502 and a second flow control portion 504 to form a non-planar reaction wave front 506. The engineered matrix bed 500 may be made out of any suitable heat-resistant material. In the embodiment of FIG. 11, the first flow portion 502 has a relatively high linear gas velocity characteristic and the second flow portion 504 has a relatively low linear gas velocity characteristic. A linear gas velocity characteristic is the propensity of a gas flowing through the matrix bed to have a certain linear velocity. The first and second flow portions 502 meet at a convoluted interface 508 that extends approximately parallel with the surface 326 of the first flow portion 502.

In an embodiment of the invention, the shape and linear gas velocity characteristics of the engineered matrix bed portions 502 and 503 are such that the reaction wave front 506 approximates the shape of the interface 508 between the portions when the reaction portion 510 of the matrix bed 500 is in the vicinity of the interface 508. During operation of the engineered matrix bed 500, the mixed gas stream 302 enters the first flow portion 502 through the surface 326 and flows to the interface 508. The reaction portion 510 of the matrix bed 500, which has been preheated to above the autoignition temperature of the gas stream 302, extends from just upstream of the interface 508 to just downstream of the interface 508. The mixed gas stream 302 oxidizes in the reaction portion 510 in a reaction wave front 506. FIG. 11 shows the non-planar reaction wave front 506 just downstream of the interface 508 and in the approximate shape of the interface 508.

By positioning the reaction portion 510 of the matrix bed 500 in the vicinity of the interface 508, the shape of the front 506 approximates the contours of the interface 508. Portions of the front 506 that drift into the first flow portion 502 are blown back to the interface 508 by the relatively high velocity of the gas stream 302 in portion 502 compared to the reaction velocity of the stream 302. Portions of the front 506 that drift into the second flow portion 502 migrate back to the interface 508 because the reaction velocity of the stream 302 is greater than the gas stream 302 flow in portion 504. Other embodiments of the invention may have differently shaped interfaces that result in non-planar wave fronts of other shapes. Further embodiments of the invention may have more than two flow portions. The engineered matrix bed 500 may be made of any suitable heat-resistant material.

As with the Bunsen and Burke-Schumann reaction wave fronts, a matrix bed with the non-planar, inverted-V wave front 370 can process a high flowrate of mixed gases and, therefore, has a relatively high overall volumetric reaction rate. This results in being able to use a smaller matrix bed, at a lower cost, to process the same amount of reactant gas streams as a larger matrix bed designed for use with a planar reaction wave front.

Figure 12:
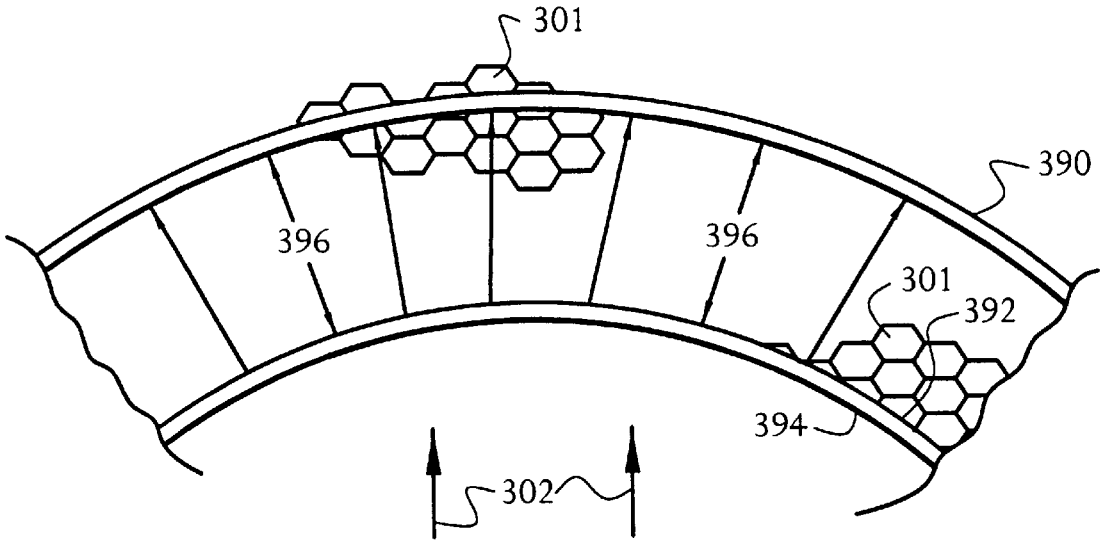
FIG. 12 is a detailed view of an embodiment of the present invention having a non-planar matrix bed surface that enables the formation of non-planar reaction wave fronts.

Now referring to FIG. 12, which illustrates another embodiment of the invention, a non-planar reaction wave front 390 is formed by flowing the mixed gas streams 302 through a non-planar surface 394 of the matrix bed 301. The non-planar reaction wave front 390 occurs approximately the same distance 396 downstream from any part of the non-planar surface 394, the distance 396 measured in a direction normal to the tangent of the part of the non-planar surface 394. The non-planar surface 394 enables a non-planar reaction wave front 390 that is larger in area than a planar reaction wave front extending over the same cross-sectional area of the matrix bed 301, and thus increases the overall volumetric reaction rate of the matrix bed. While the shown embodiment of the invention has a bed support 392 at the non-planar surface, other embodiments of the invention may not have a support. Additional embodiments of the invention may use matrix beds with non-planar surfaces in a stabilized reaction wave flameless thermal oxidizer, a recuperative heating flameless thermal oxidizer, or a regenerative bed incinerator system.

Figure 13:
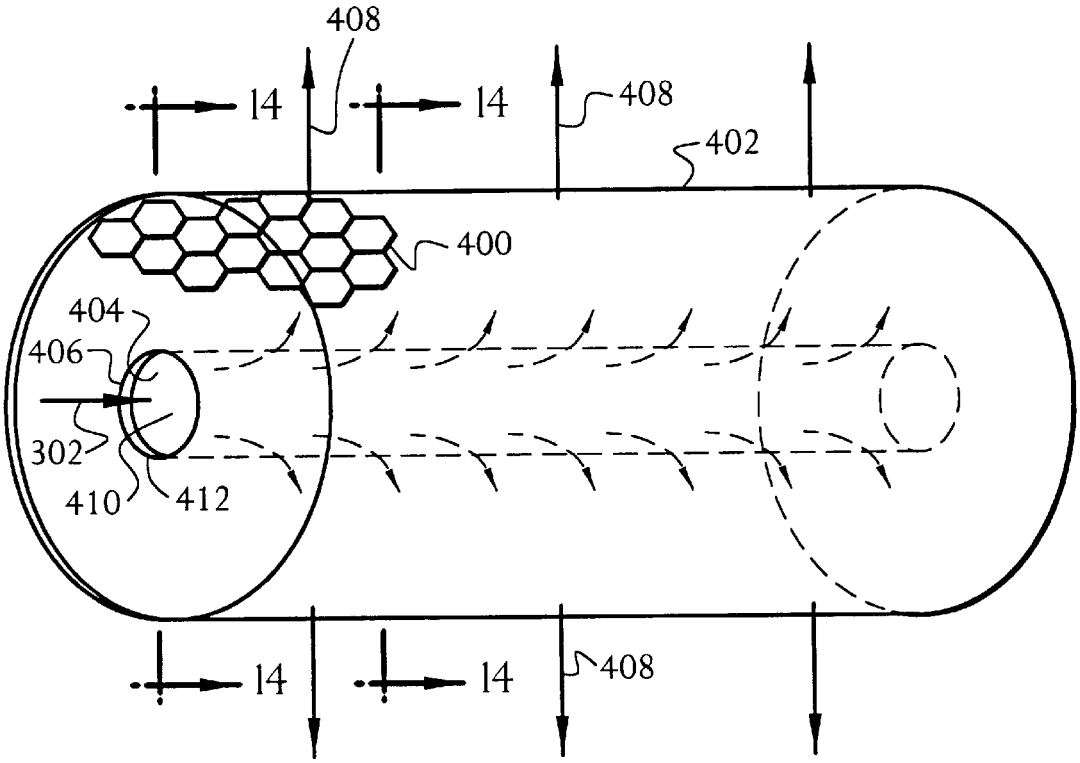
FIG. 13 is an isometric view of an embodiment of the present invention having a cylindrically-shaped matrix bed with reactant gas streams flowing radially therethrough.
Figure 14:
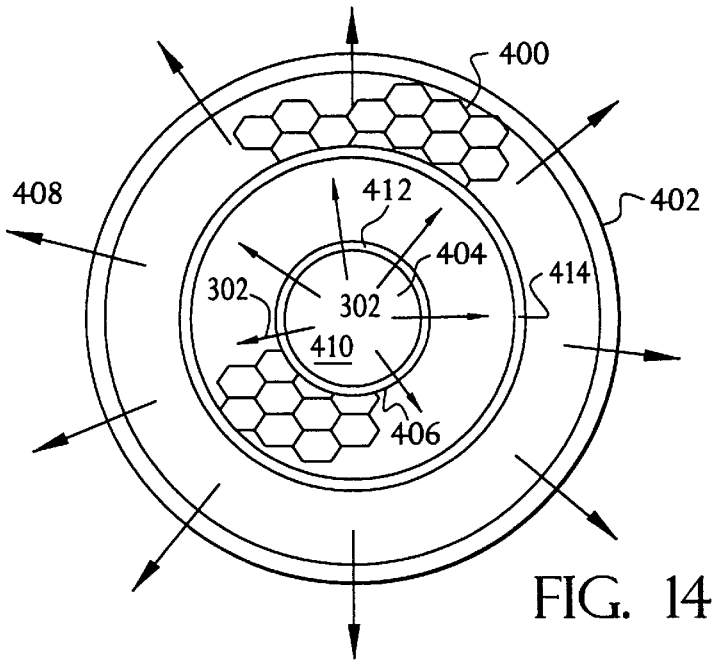
FIG. 14 is a lateral cross-sectional view through line 14—14 of the cylindrically-shaped matrix bed of FIG. 13.
Figure 15:
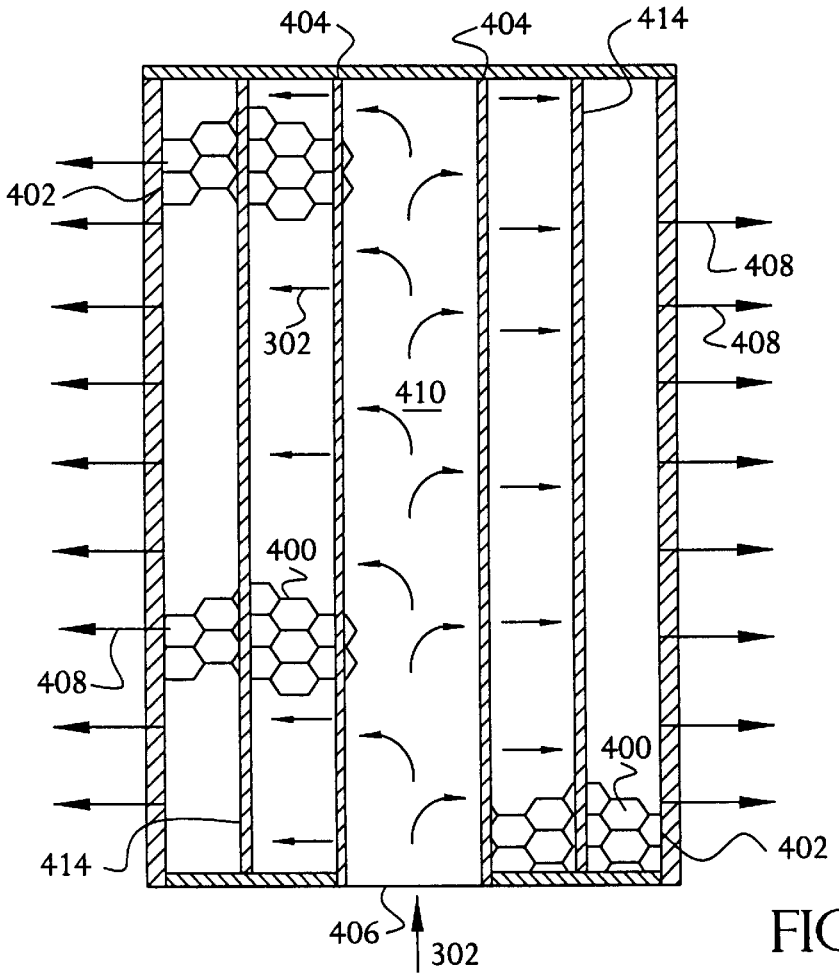
FIG. 15 is an axial cross-sectional view through line 15—15 of the cylindrically-shaped matrix bed of FIG. 13.

Now referring to FIGS. 13, 14, and 15, an embodiment of the invention provides for a matrix bed 400 comprising heat-resistant material, with an exterior surface 402 and a non-planar interior surface 404. The interior surface 404 extends to an opening 406 in the exterior surface 402. The interior surface 404 and the exterior surface 402 define co-axial cylinders. The mixed gas stream 302 is directed through the opening 406 and into an interior space 410 defined by the interior surface 404. The mixed gas stream 302 then flows through a bed support 412 that is adjacent to the non-planar surface 404 and into the matrix bed 400 in a radial direction. Other embodiments of the invention may not have a bed support 412.

The matrix bed 400 has been preheated to produce a radially increasing temperature profile such that the reaction temperature of the mixed gas stream 302 occurs in a cylindrical region nested between the interior surface 404 and the exterior surface 402. In this region, the mixed gas stream 302 rapidly reacts and forms a non-planar, cylindrical reaction wave front 414. The reactions occurring in the front 414 produce a reaction products gas stream 408 that exits the matrix bed through the exterior surface 402. This arrangement provides for a matrix bed with a high area of reaction wave front to volume of matrix bed and, therefore, a high overall volumetric reaction rate compared to matrix beds having a conventional planar reaction wave front along a latitudinal cross-section. Other embodiments of the invention may have the interior surface 404 defining more than two openings 406 for the mixed gas stream to enter the interior space 410, such as an opening at both ends of the cylindrically shaped matrix bed 400.

Now referring to FIG. 16, the non-planar interior surface may have other shapes, such as a spherical, non-planar interior surface 420 of a spherical matrix bed 422 having a spherical exterior surface 430 that is concentric with the interior surface 420. The matrix bed 422 is comprised of the same heat-resistant matter as in the matrix bed 301. The interior surface 420 defines a spherical space 432 and a passage 426 extending therefrom to the exterior surface 430, defining an opening 424 thereat. The mixed gas stream 302 is directed into the opening 424, through the cylindrical passage 426 and into the spherical space 432. From the space 432, the stream 302 flows radially through the interior surface 420 and into the matrix bed 422.

The matrix bed 422 has been preheated to produce a radially increasing temperature profile such that the reaction temperature of the mixed gas stream 302 occurs in a spherical reaction portion of the bed nested between the interior surface 420 and the exterior surface 430. In this portion, the mixed gas stream 302 rapidly reacts and forms a non-planar, spherical reaction wave front 428. The reactions occurring in the front 428 produce a reaction products gas stream 408 that exits the matrix bed through the exterior surface 430. Other embodiments of the invention may have interior surfaces of other, non-planar shapes, such as hemispherical, and other exterior shapes that are not necessarily the same shape as the space formed by the interior surface. Further embodiments may have a plurality of interior surfaces, such as a matrix bed having a cubical exterior surface and a plurality of cylindrically shaped interior spaces. Additional embodiments of the invention may use matrix beds with non-planar interior surfaces in a stabilized reaction wave flameless thermal oxidizer, a recuperative heating flameless thermal oxidizer, or a regenerative bed incinerator system.

Now referring to FIGS. 17A–D, segments of a cylindrically-shaped matrix bed 440 are shown with four alternative embodiments of the invention for generating a reaction wave front of a larger area than the wave front 414 in the embodiment of the invention shown in FIG. 14. The matrix bed 440 has been previously heated to produce a radially increasing temperature profile such that the reaction temperature of the mixed gas stream 302 occurs in a cylindrical reaction portion nested between the space 410 and the exterior surface 444.

Now referring to FIG. 17A, the mixed gas stream 302 flows radially from space 410, into a first open end 446 of a plurality of tubes 448, and out through a second opening 450, with each tube extending through an interior surface 442. Upon entering the matrix bed 440, the mixed gas streams react to form the non-planar, Bunsen reaction wave fronts 300 as described previously, with the second openings 450 forming a non-planar locus of points. Other embodiments of the invention may utilize a manifold, as previously described in connection with the Bunsen reaction wave fronts 300.

Now referring to FIG. 17B, the portion 334 of the plurality of reactant gas streams flows through the bed support 452 with the other portion 336 of the plurality of reactant gas streams flowing from a manifold 454 having outlets 331 downstream of an interior surface 442 adjacent to the bed support. The outlets 331 form a non-planar locus of points. As previously described, in the preferred embodiment of the invention, the portion 334 is a mixture of the reactant gas streams that comprise air and/or oxygen and the portion 336 is a mixture of the reactant gas streams that comprise oxidizable gases. Upon the portions entering the matrix bed 440 and interdiffusing, the non-planar, Burke-Schumann reaction wave fronts 330 are formed as previously described.

Now referring to FIG. 17C, a plurality of rods 374 extend parallel to the central axis of the matrix bed 440, forming the wave holder means. As the mixed gas stream 302 flows from the space 410 and into the matrix bed 440, the stream reacts and forms the non-planar, inverted-V reaction wave front 370, as previously described. In the embodiment of the invention shown in FIG. 17C, an apex 371 of each inverted-V reaction wave front 370 extends in a direction parallel to the central axis of the matrix bed.

Now referring to FIG. 17D, the interior surface 456 of the matrix bed 440 is convoluted compared to interior surface 456 of the cylindrical matrix bed shown in FIG. 14. The mixed gas stream 302 passes from the space 410, through the interior surface 456, and into the matrix bed 440. The mixed gas stream 302 reacts the same distance 460 from the interior surface 456 to form a convoluted, non-planar reaction wave front 390, having a larger area than the non-planar, reaction wave front 414 of the embodiment of the invention shown in FIG. 14. Other embodiments of the invention may use the previously described engineered matrix beds 500 to generate a reaction wave front of a larger area than the wave front 414 in the embodiment of the invention shown in FIG. 14 (not shown).

Now referring to FIGS. 18 and 19, a cylindrical matrix bed 400 has a plurality of rods 466 disposed between the interior surface 404 and the exterior surface 402. Each rod 466 is formed into a circle that is concentric with the central axis of the matrix bed 400 and that forms a plane that is normal to the axis of the matrix bed. The rods 466 are bluff bodies that create a plurality of non-planar, inverted-V reaction wave fronts 370, with the apex 371 of each front extending circumferentially about the central axis of the matrix bed, as shown in FIG. 19.

As is shown in embodiments of the invention of FIGS. 17A–D, 18 and 19, the relatively smooth, non-planar reaction wave front 414 of the matrix bed 400 will have an increased area if the matrix bed is modified to generate either the Bunsen reaction wave fronts 300, Burke-Schumann reaction wave fronts 330, the inverted-V reaction wave front 370, the convoluted reaction wave front 458, or a combination thereof. This increased area translates into an increased overall volumetric reaction rate of the matrix bed. Further, other embodiments of this invention may use matrix beds modified to generate the above-mentioned non-planar reaction wave fronts in a stabilized reaction wave flameless thermal oxidizer, a recuperative heating flameless thermal oxidizer, or a regenerative bed incinerator system.

Therefore, by modifying the design of the matrix bed such that the area of the reaction wave front of a plurality of reactant gas streams reacting in the matrix bed increases, the overall volumetric reaction rate of the matrix bed increases. With the overall volumetric reaction rate increase, a given matrix bed will process more of the reactant gas streams with low additional cost.

Although the present invention has been described above with respect to particular preferred embodiments, it will be apparent to those skilled in the art that numerous modifications and variations can be made to those designs. For example, any of the above embodiments of the invention may have a means to monitor the temperature profile of the matrix bed and a means for adjusting the non-planar reaction wave front by varying the flowrates of at least a portion of the reactant gas streams, as is disclosed in the prior art. However, in the context of the present invention, "adjusting" shall be understood to mean maintaining or changing the position of the reaction wave front in the matrix bed, the shape of the reaction wave front, the character of the reaction wave front (i.e. temperature, composition, etc.), or a combination thereof. The descriptions provided are for illustrative purposes and are not intended to limit the invention.

We claim:

1. A thermal reactor for optimizing the reaction rate of one or more reactant gas streams by forming at least a non-planar reaction wave front therefrom, comprising:

a) a matrix bed of heat-resistant material comprising a matrix bed surface having an upstream side and a downstream side adjacent to the matrix bed and heating means for heating the matrix bed until at least a reaction portion of the matrix bed is above the temperature required for the reactant gas streams to react and to form a reaction product gas stream therefrom;

b) gas entry means for directing the reactant gas streams into the matrix bed through the matrix bed surface such that the non-planar reaction wave front is formed in the matrix bed reaction portion;

c) temperature means for monitoring a temperature profile of the matrix bed;

d) control means for varying the reactant gas streams' flowrates in response to the monitored temperature profile; and e) exit means for the reaction product gas stream to exit the matrix bed.

2. The reactor of claim 1 wherein:

a) the matrix bed surface includes a non-planar matrix bed surface that at least partially defines an interior space of the matrix bed; and b) the gas entry means comprises an opening in an exterior surface of the matrix bed that extends to an interior space of the matrix bed.

3. The reactor of claim 2 wherein at least a portion of the interior space defines a generally spherical space.

4. The reactor of claim 3 wherein at least a portion of the matrix bed has a generally spherical shape that is substantially concentric with the generally spherical shape of the interior space.

5. The reactor of claim 1 wherein at least a portion of an interior space of the matrix bed defines a generally cylindrical shape.

6. The reactor of claim 5 wherein at least a portion of the matrix bed has a generally cylindrical shape that is substantially co-axial with the generally cylindrical shape of the interior space.

7. The reactor of claim 1 wherein the gas entry means comprises gas flow means for directing the reactant gas streams into the matrix bed through one or more introduction locations located downstream of the matrix bed surface and forming one or more Bunsen reaction wave fronts in the matrix bed reaction portion therefrom.

8. The reactor of claim 7 wherein the introduction locations form a non-planar locus of points.

9. The reactor of claim 1 wherein the gas entry means comprises gas flow means for:

a) directing a first portion of the reactant gas streams into the matrix bed through one or more introduction locations located downstream of the matrix bed surface;

b) directing a second portion of the reactant gas streams into the matrix bed through a gas flow surface on at least a portion of the matrix bed surface; and c) forming one or more Burke-Schumann reaction wave fronts in the matrix bed reaction portion from the first and second portions of the reactant gas streams.

10. The reactor of claim 9 wherein the introduction locations form a non-planar locus of points.

11. The reactor of claim 1 further comprising wave holder means disposed in the matrix bed reaction portion for anchoring an inverted-V reaction wave front.

12. The reactor of claim 11 further comprising heating means for heating the wave holder means.

13. The reactor of claim 11 wherein the wave holder means comprises one or more bluff bodies disposed in the matrix bed reaction portion.

14. The reactor of claim 11 wherein the wave holder means comprises one or more pilots disposed in the matrix bed reaction portion.

15. The reactor of claim 11 wherein the wave holder means comprises one or more raw fuel jets disposed in the matrix bed reaction portion.

16. The reactor of claim 1 wherein:

a) the non-planar matrix bed surface at least partially defines an interior space of the matrix bed; and b) the gas entry means comprises an opening in an exterior surface of the matrix bed that extends to the interior space.

17. The reactor of claim 16 wherein:

a) at least a portion of the interior surface defines a generally cylindrical space; and b) the wave holder means comprises at least a rod disposed substantially parallel to the portion of the interior surface that defines a generally cylindrical surface.

18. The reactor of claim 16 wherein:

a) at least a portion of the interior surface defines a generally cylindrical space; and b) the wave holder means comprises at least a curved rod that defines a plane that is generally perpendicular to the portion of the interior surface that defines a generally cylindrical surface.

19. A method of increasing the overall volumetric reaction rate within a matrix bed, comprising heat-resistant material and having at least a gas permeable matrix bed surface, by forming at least a Burke-Schumann reaction wave front therein, comprising the steps of:

(a heating the matrix bed until at least a reaction portion of the matrix bed is above the temperature required for one or more reactant gas streams to react;

(b mixing a first portion of the reactant gas streams to form a first mixed gas stream;

(c mixing a second portion of the reactant gas streams to form a second mixed gas stream;

(d dividing the first mixed gas stream into a one or more individual gas streams;

(e introducing the individual gas streams into the matrix bed at one or more introduction locations downstream of the gas permeable matrix bed surface;

(f directing the second mixed gas stream through the gas permeable matrix bed surface in a manner so to form the Burke-Schumann reaction wave front in the reaction portion of the matrix bed, and a reaction product gas stream; and (g exhausting the reaction product gas stream from the matrix bed.

20. The method of claim 19 wherein the mixing step further comprises the steps of:

(a using reactant gas streams comprising oxidizable gases to form the first mixed gas stream; and (b using reactant gas streams comprising air and/or oxygen to form the second mixed gas stream.

21. The method of claim 19 wherein the introducing step further comprises the step of introducing the individual gas streams into the matrix bed at a plurality of introduction locations downstream of the matrix bed surface, wherein the plurality of introduction locations form a non-planar locus of points.

22. The method of claim 19 further comprising the steps of:

(a monitoring the temperature profile of the matrix bed; and (b adjusting the location or shape of the reaction wave front by varying the flowrates of at least a portion of the reactant gas streams.

23. The method of claim 22 further comprising the step of recuperating heat into the reactant gases from the matrix bed by passing the reactant gas streams through pipes that extend through the heated matrix bed.

24. A thermal reactor for optimizing the reaction rate of a plurality of reactant gas streams by forming one or more Burke-Schumann reaction wave fronts therefrom, comprising:

a) a matrix bed of heat-resistant material comprising at least a matrix bed surface having an upstream side and a downstream side adjacent to the matrix bed;

b) heating means for heating the matrix bed until at least a reaction portion of the matrix bed is above the temperature required for the reactant gas streams to react and to form a reaction product gas stream therefrom;

c) gas entry means for i) directing a first portion of the reactant gas streams into the matrix bed through one or more introduction locations located downstream of the matrix bed surface;

ii) directing a second portion of the reactant gas streams into the matrix bed through a gas flow surface on at least a portion of the matrix bed surface; and iii) forming the Burke-Schumann reaction wave fronts in the matrix bed reaction portion from the first and second portions of the reactant gas streams;

d) temperature means for monitoring a temperature profile of the matrix bed;

e) control means for varying the reactant gas streams' flowrates in response to the monitored temperature profile; and f) exit means for the reaction product gas stream to exit the matrix bed.

25. The reactor of claim 24 wherein the gas entry means comprises at least a manifold having one or more outlets located at the introduction locations, respectively, and one or more inlets connected to a source of the first portion of the reaction gas streams.

26. The reactor of claim 24 wherein the gas entry means comprises one or more tubes extending through the matrix bed surface, each tube having a first and a second open end, and wherein the first open end of each tube is located at, or upstream of, the matrix bed surface and is in connection with a source of the first portion of the reaction gas streams, and the second open end of each tube is located at the introduction locations, respectively.

27. A thermal reactor for optimizing the reaction rate of one or more reactant gas streams by forming at least a non-planar reaction wave front therefrom, comprising:

a) a matrix bed of heat-resistant material comprising:

i) a plurality of flow control portions of varying linear gas velocity characteristics; and ii) heating means for heating the matrix bed until at least a reaction portion of the matrix bed is above the temperature required for the reactant gas streams to react and to form a reaction product gas stream therefrom;

b) gas entry means for directing the reactant gas streams through the matrix bed reaction portion;

c) temperature means for monitoring a temperature profile of the matrix bed;

d) control means for varying the reactant gas streams volumetric flowrates in response to the monitored temperature profile; and e) exit means for the reaction product gas stream to exit the matrix bed.

28. The reactor of claim 27 wherein the entry means further comprises a non-planar matrix bed surface.

29. The reactor of claim 28 wherein:

a) the non-planar matrix bed surface at least partially defines an interior space of the matrix bed; and b) the gas entry means further comprises an opening in an exterior surface of the matrix bed that extends to the interior space.

30. The reactor of claim 29 wherein at least a portion of the interior space defines a generally cylindrical shape.

31. The reactor of claim 30 wherein at least a portion of the matrix bed has a generally cylindrical shape that is substantially co-axial with the generally cylindrical shape of the interior space.

32. The reactor of claim 29 wherein at least a portion of the interior space defines a generally spherical space.

33. The reactor of claim 32 wherein at least a portion of the matrix bed has a generally spherical shape that is substantially concentric with the generally spherical shape of the interior space.

34. A method of oxidizing a gas stream in a matrix bed having a heat-resistant material and a matrix bed surface, comprising the steps of:

a) heating the matrix bed until at least a reaction portion of the matrix bed is above the temperature required for one or more reactant gas streams to react;

b) introducing the gas stream into the matrix bed at one or more introduction locations within the matrix bed downstream of the matrix bed surface in a manner so to increase an overall volumetric reaction rate reaction within the matrix bed by forming a non-planar reaction wave front in the reaction portion of the matrix bed; and c) exhausting the reaction product gas stream from the matrix bed.

35. The method of claim 34 wherein step b) includes forming a Bunsen reaction wave front.

36. The method of claim 34 wherein step b) includes forming a Burke-Schumann reaction wave front.

37. The method of claim 34 wherein step b) includes forming an inverted-V reaction wave front.

38. The method of claim 34 wherein step b) includes introducing the gas stream into a non-planar matrix bed surface.

39. The reactor of claims 24, 1, or 27 wherein the reactor is a stabilized reaction wave flameless thermal oxidizer, a recuperative heating flameless thermal oxidizer, or a regenerative bed incinerator system.

* * * * *